US006408458B1

(12) United States Patent
Chilton

(10) Patent No.: US 6,408,458 B1
(45) Date of Patent: Jun. 25, 2002

(54) SHOWER CURTAIN SPLASH ACCESSORY

(76) Inventor: Ralph H. Chilton, 108 N. Cove Dr., Ponte Vedra Beach, FL (US) 32082

( * ) Notice: Subject to any disclaimer, the term of this patent is extended or adjusted under 35 U.S.C. 154(b) by 0 days.

(21) Appl. No.: 09/670,802

(22) Filed: Sep. 28, 2000

Related U.S. Application Data

(63) Continuation-in-part of application No. 09/413,952, filed on Oct. 7, 1999, now Pat. No. 6,195,817.

(51) Int. Cl.[7] ..... A47K 3/00
(52) U.S. Cl. ..... 4/609
(58) Field of Search ..... 4/558, 608–610

(56) References Cited

U.S. PATENT DOCUMENTS

| | | | | |
|---|---|---|---|---|
| 2,554,106 A | | 5/1951 | Heubeck | 160/349 |
| 2,712,354 A | | 7/1955 | Margolies | 160/330 |
| 2,878,487 A | * | 3/1959 | Foote | 4/610 |
| 3,639,919 A | | 2/1972 | White | 4/149 |
| 4,769,862 A | | 9/1988 | Skrzelowski | 4/610 |
| 4,887,324 A | | 12/1989 | Cairns | 4/609 |
| 5,201,081 A | | 4/1993 | Knight | 4/609 |
| 5,371,908 A | | 12/1994 | Secondine | 4/609 |
| 5,561,870 A | | 10/1996 | Hertel | 4/609 |

* cited by examiner

*Primary Examiner*—Charles E. Phillips

(57) ABSTRACT

A shower curtain splash accessory having an elongated edge member and hangar means, for hanging the splash accessory from a curtain rod, having a depending rod for supporting the elongated edge member in a generally upright position below the curtain rod. The edge member has a hub mounted on the depending rod, a wide radial flap on the hub and means for attaching a leading edge section of curtain to the flap. The edge member can be vertically and angularly positioned on the depending rod to vertically and angularly position the flap so that it extends, forwardly and inwardly, at an angle preferably between 30 to 90 degrees from the vertical plane of the curtain rod. The hangar means is shiftable on the curtain rod to shift the edge member and attached curtain between a withdrawn position permitting entrance into and egress from the shower enclosure and a forward position next to an opposed shower wall where the flap and attached curtain provide a splash shield and splash barrier, respectively, extending inwardly of and across the end of the curtain opening.

17 Claims, 7 Drawing Sheets

SHOWER CURTAIN SPLASH ACCESSORY

The present application is a continuation-in-part of pending application Ser. No. 09/413,952, filed Oct. 7, 1999, now U.S. Pat. No. 6,195,877 and entitled "Shower Curtain Splash Accessory".

FIELD OF INVENTION

The present invention relates to shower curtain accessories for preventing splashing water from escaping between the end of a shower curtain and an opposed shower wall. More specifically, the present invention relates to splash accessories of the type hung from a shower curtain rod and operable to position and/or which otherwise cooperate with a leading edge section of curtain to form an improved splash barrier at the end of the curtain opening.

SUMMARY OF THE INVENTION

A principal object of the present invention is to provide a new and improved splash accessory of the type described which cooperates with the shower curtain to provide a more effective splash barrier at the end of the shower curtain opening. In accordance with this object, the accessory has an upright, elongated edge member with an upright, elongated flap angled laterally inwardly from the vertical plane of the curtain rod. When the splash accessory is positioned next to an opposed shower wall, the flap provides a lateral splash shield inwardly of and across the end of the shower curtain opening.

Another object of the present invention is to provide a new and improved splash accessory of the type described, adapted to position a leading edge section of shower curtain inwardly of the vertical plane of the curtain rod to provide a more effective splash barrier at the end of the shower curtain opening.

Another object of the present invention is to provide a new and improved splash accessory of the type described having an upright, elongated edge member with an upright, elongated flap adapted to cooperate with a leading edge section of shower curtain in different ways to form an improved splash barrier at an end of a shower curtain opening. The edge member is vertically and angularly positioned about a longitudinally extending axis according to the length of the flap and how it is used. For optimum effectiveness, the flap extends approximately the full height of the curtain opening and is angularly positioned to extend forwardly and inwardly from the vertical plane of the curtain rod. A leading edge section of curtain is folded around a leading edge of the flap and attached to the opposite side of the flap, is attached to the adjacent side of the flap or is merely suspended from the curtain rod in overlapping relationship with the flap.

Another object of the present invention is to provide a new and improved splash accessory of the type described which can be easily shifted along a curtain rod to a forward position next to an opposed shower wall where it provides an effective splash barrier inwardly of and across the end of the shower curtain opening or to a withdrawn position providing an opening for entrance into and egress from the shower enclosure.

Another object of the present invention is to provide a new and improved splash accessory of the type described which can be easily installed and which can be used with conventional shower curtains and bathtub and other types of shower enclosures, all without modification, and with the curtain on either the right-side or left-side of the shower and the accessory on either the inside or outside of the curtain.

Another object of the present invention is to provide a new and improved splash accessory of the type described, which has a smooth and attractive appearance, which can be easily cleaned, which has a durable construction of primarily plastic parts, and which can be economically manufactured and assembled.

Other objects and advantages will become apparent from the following detailed description and accompanying drawings.

BRIEF DESCRIPTION OF THE DRAWINGS

In the drawings, in which like reference numerals identify the same or like parts.

DETAILED DESCRIPTION OF PREFERRED EMBODIMENTS

An embodiment of a shower curtain splash accessory 10 incorporating the present invention is shown in FIGS. 1–4, 7–9, and 13–16. The remaining FIGS. 5, 6, and 10–12 show modifications. All of the parts of the accessory, except set screws 33, are made of plastic.

Figure 1:
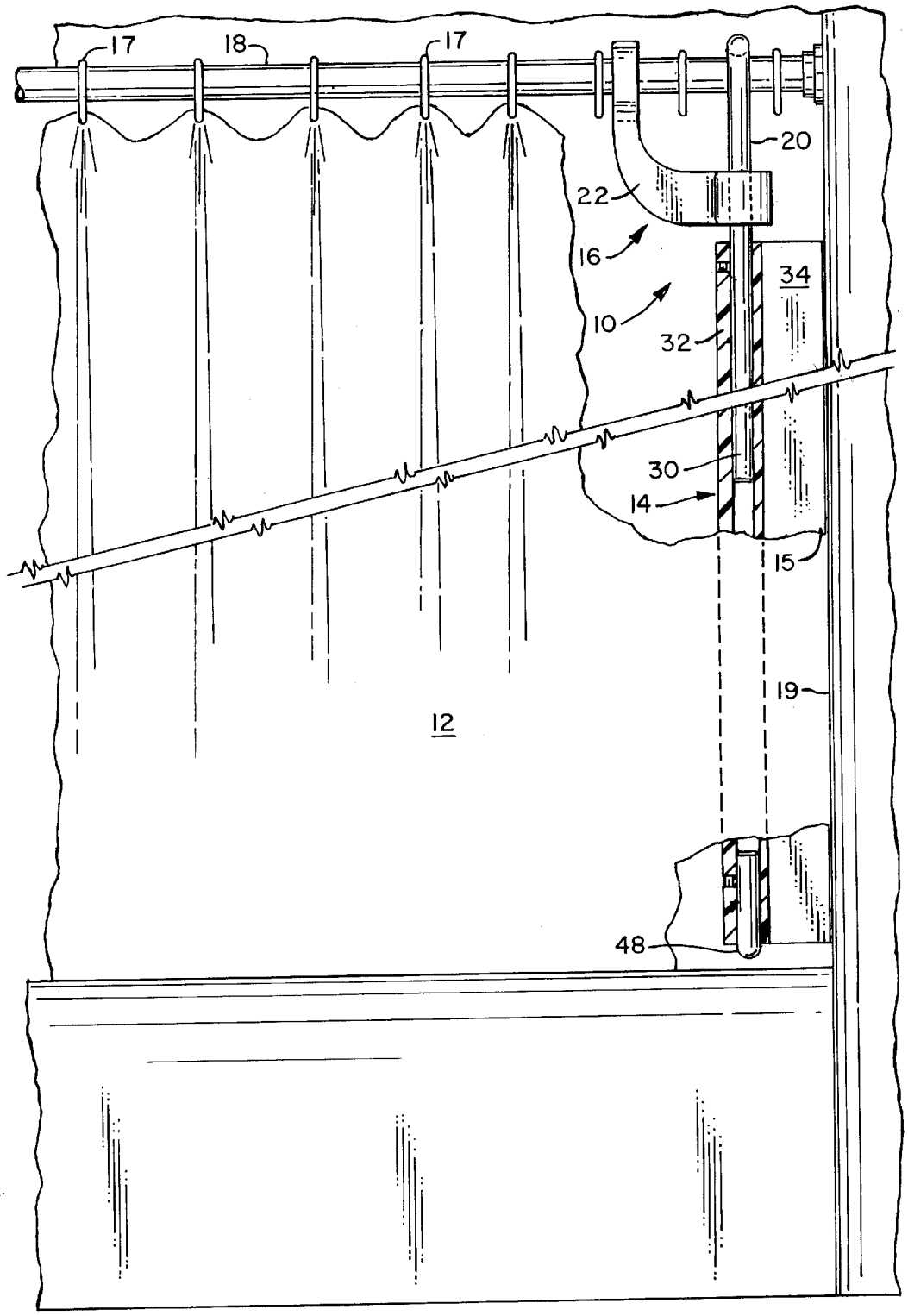
FIG. 1 is a side elevation view showing a shower curtain splash accessory incorporating the present invention installed in a bathtub type shower enclosure.
Figure 2:
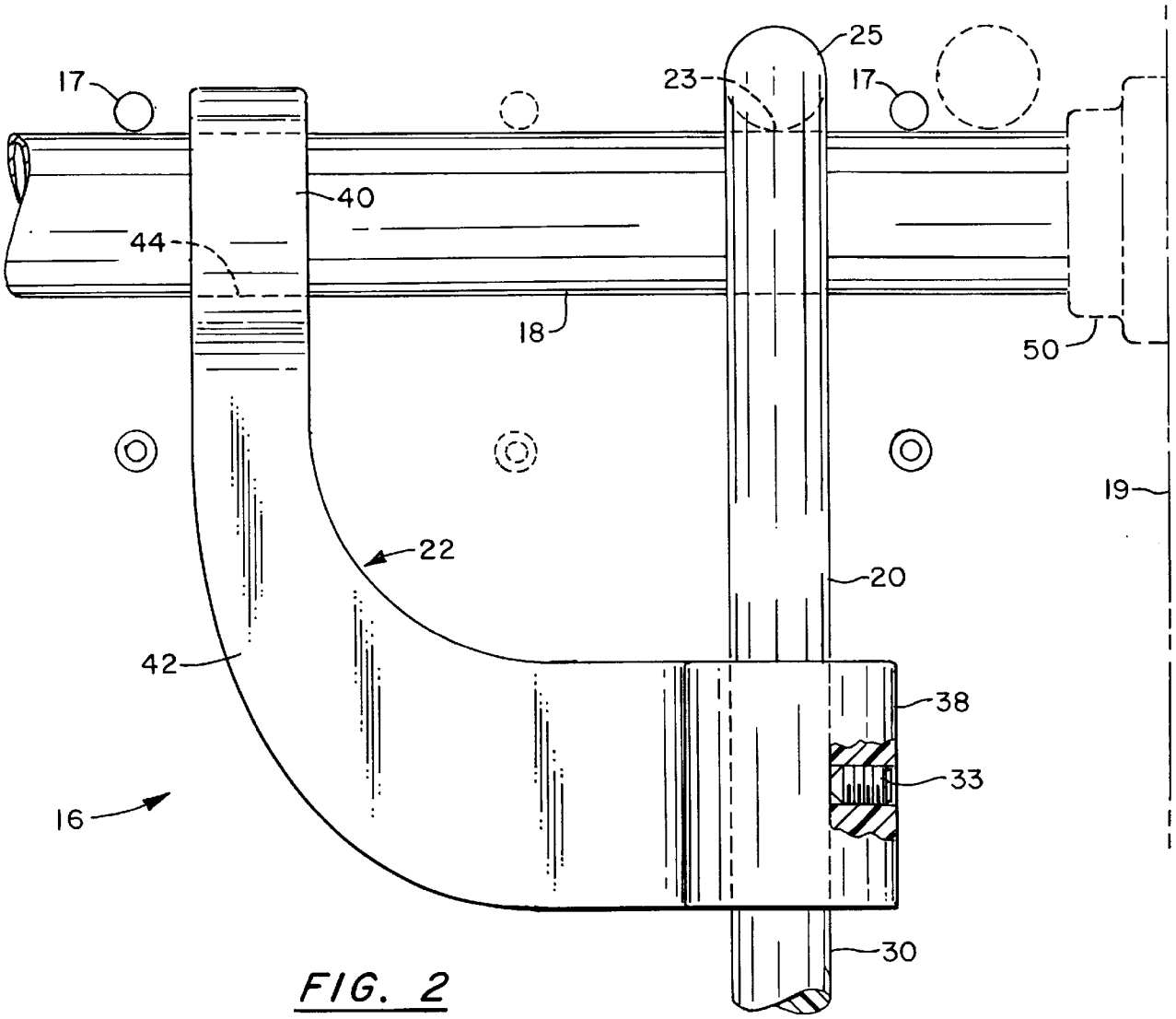
FIG. 2 is an enlarged partial side elevation view of the installation of FIG. 1, showing an upper hangar assembly of the splash accessory.
Figure 4:
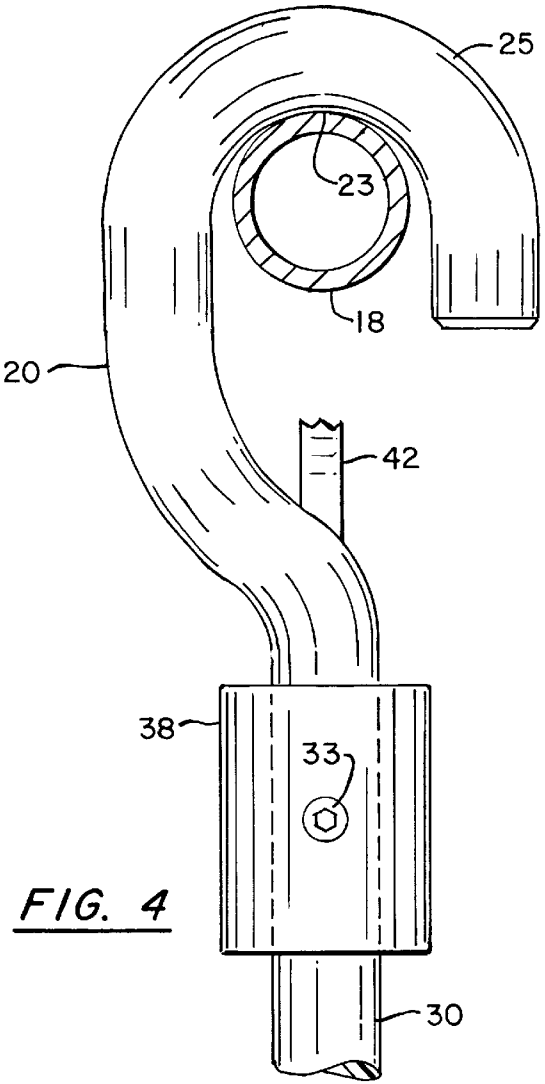
FIGS. 3 and 4 are partial elevation section views, showing rear and front end views, respectively, of the upper hangar assembly.
Figure 3:
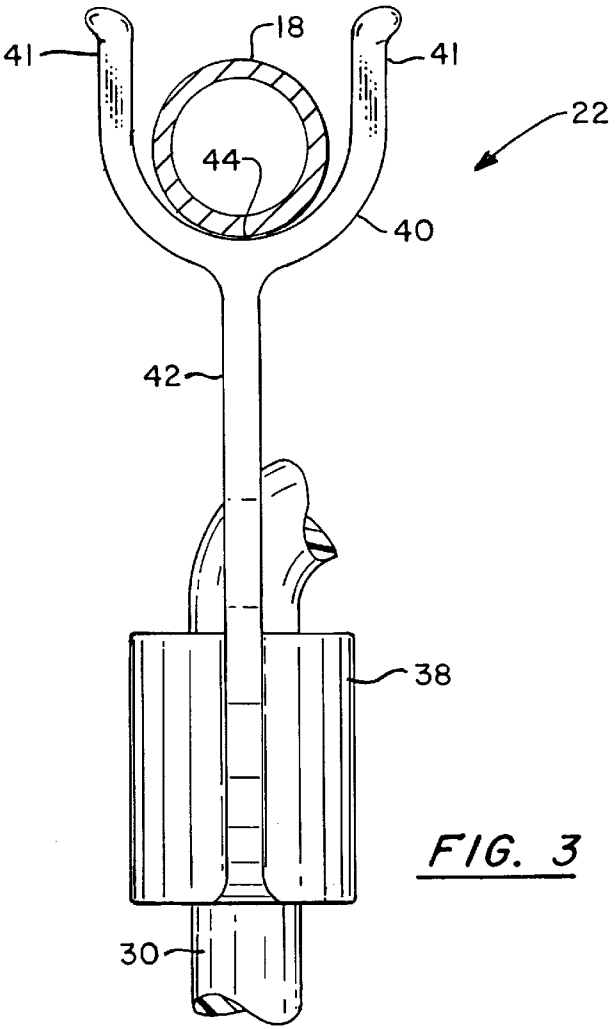
Figure 6:
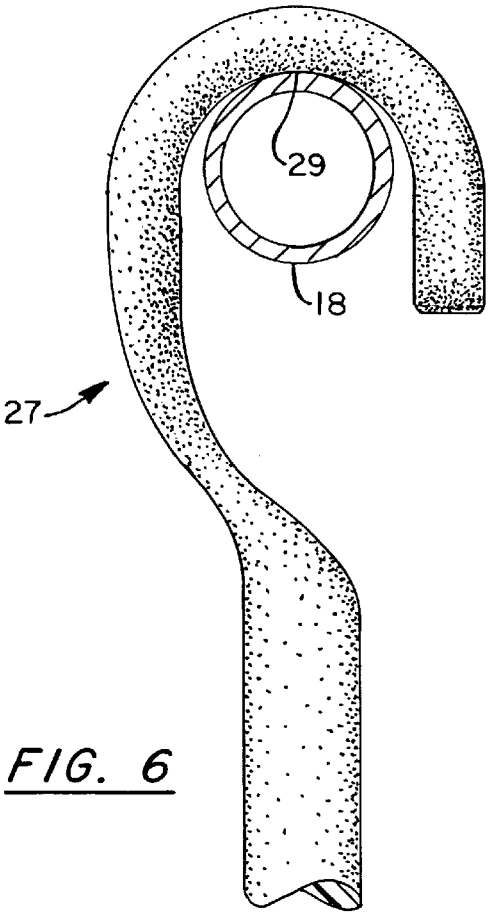
FIG. 6 is a partial elevation section view, showing a front end view of the modified hangar rod of FIG. 5.
Figure 5:
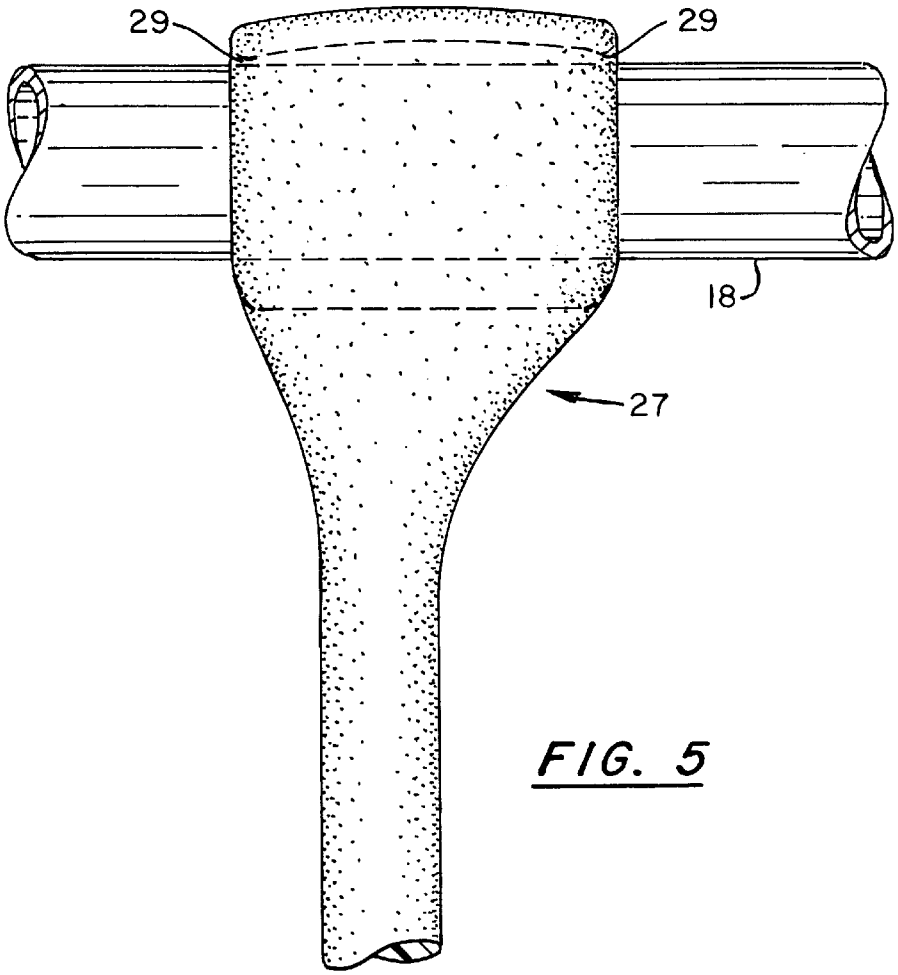
FIG. 5 is a partial side elevation view, showing a modified hangar rod of the upper hangar assembly.

Referring to FIG. 1, the accessory 10 is shown installed in a bathtub type shower enclosure having a shower curtain 12 suspended from a horizontal curtain rod 18 by curtain rings 17. The accessory 10 has an elongated, auxiliary edge member 14 and a hangar assembly 16 for hanging the accessory 10 from the curtain rod 18 with the elongated edge member 14 suspended in a generally upright position below the rod 18 and within the shower curtain opening. The accessory 10 is manually shifted on the curtain rod 18 to position the edge member 14 next to or withdrawn from an opposed shower wall 19 at one end of the shower curtain opening.

The hangar assembly 16 comprises a front hangar rod 20 and a rear guide 22.

The hangar rod 20 has a circular cross-section, an upper support collar or hook 25 for hanging the accessory 10 from the curtain rod 18 and a straight depending rod 30 for supporting the rear guide 22 and edge member 14. The depending rod 30 preferably has a length of 30 to 120 cm depending on the length and vertical position of the edge member 14.

The support collar 25 has a semi-circular seat 23 with a convex pivot edge engaging the curtain rod 18. The seat 23 (and semi-circular seats 29, 44 of collars 27, 40) are slightly larger than the curtain rod 18 to facilitate movement of the accessory 10 along the curtain rod 18. The top or center of the seat 23 is aligned with the axis of the depending rod 30 (as shown in full lines in FIG. 2) or is offset slightly (e.g., 3 cm) from the rod axis (i.e., forwardly from the rod axis as shown in broken lines in FIG. 2 or rearwardly from the rod axis by reversing the position of the hangar rod 20 on the curtain rod 18) by molding the hangar rod 20 with the transverse plane of the support collar 25 inclined slightly from the axis of the depending rod 30. The hangar rod may employ a strap-like support collar 27, shown in FIGS. 5 and 6, in place of support collar 25. In collar 27, the collar strap is bowed outwardly to form two, spaced, semicircular seats 29. The two seats 29 are offset in opposite directions, preferably with different offsets (e.g., 3 cm and 2 cm offsets) from the axis of the depending rod 30 to form a stable support for suspending the depending rod 30 with its axis perpendicular to the curtain rod 18. Each seat 29 has a convex pivot edge which can be used as the front pivot edge of the accessory by mounting the hangar rod 20 in the appropriate direction on the curtain rod 18.

The guide 22 has a molded plastic body with a hub 38 mounted on the depending rod 30, an upright, generally U-shaped, guide collar 40 receiving the curtain rod 18 and an intermediate rigid connector 42. Upstanding legs 41 of the guide collar 40 flare outwardly to prevent interference with the curtain rings 17. The guide collar 40 has a semi-circular seat 44 engageable with the curtain rod 18 to help orient the accessory on the rod 18 and help resist accessory movement along the rod 18, most importantly when the edge member 14 is next to the shower wall 19.

The guide 22 is vertically positioned on the rod 30 to provide the desired inclination of the upright edge member 14. With a support collar having a non-offset or rearwardly offset seat 23, the weight of the splash accessory 10 (including any curtain weight supported by the accessory) biases the edge member 14 rearwardly and the guide collar 40 upwardly about the pivot edge of the seat 23. The guide collar 40 thereby establishes the angle at which the depending rod 30 is suspended from the curtain rod 18. With a support collar having a forwardly offset seat 23 or 29, the bias is significantly less or in the opposite or forward direction, depending on the amount of forward offset, the angular orientation of the edge member 14, and the curtain weight, if any, supported by the edge member. The rear guide 22 may be eliminated if the bias is in the forward direction. The support rod 30 is preferably suspended parallel to the shower wall 19 and therefore perpendicular to the curtain rod 18.

The edge member 14 has an extruded plastic body with a rear hub 32 mounted on the depending rod 30 and a wide flap or blade 34 extending laterally outwardly (and preferably radially, as shown) from the hub 32 to an outer end or edge 15 (preferably, at least 5 cm and optimally, between 7 to 9 cm from the hub axis). The lateral flap 34 is preferably flat and rigid and yet relatively thin and light. The hub 32, and hub 42 of rear guide 40, have enlarged, external ribs for mounting radial set screws 33. The set screws 33 are employed to firmly secure the edge member 14 and rear guide 40 to the depending rod 30 after they are manually positioned, vertically and angularly, on the rod 30. A rod 48 is similarly secured within the bottom of the hub 32. Instead of set screws 33, a suitable cement may be used to secure the parts together. The edge member body (excluding threaded radial openings in the hub 32 for set screws 33) has a constant, symmetrical cross-section. The hub 32 serves as a handle for manually shifting the accessory on the curtain rod 18.

Figure 13:
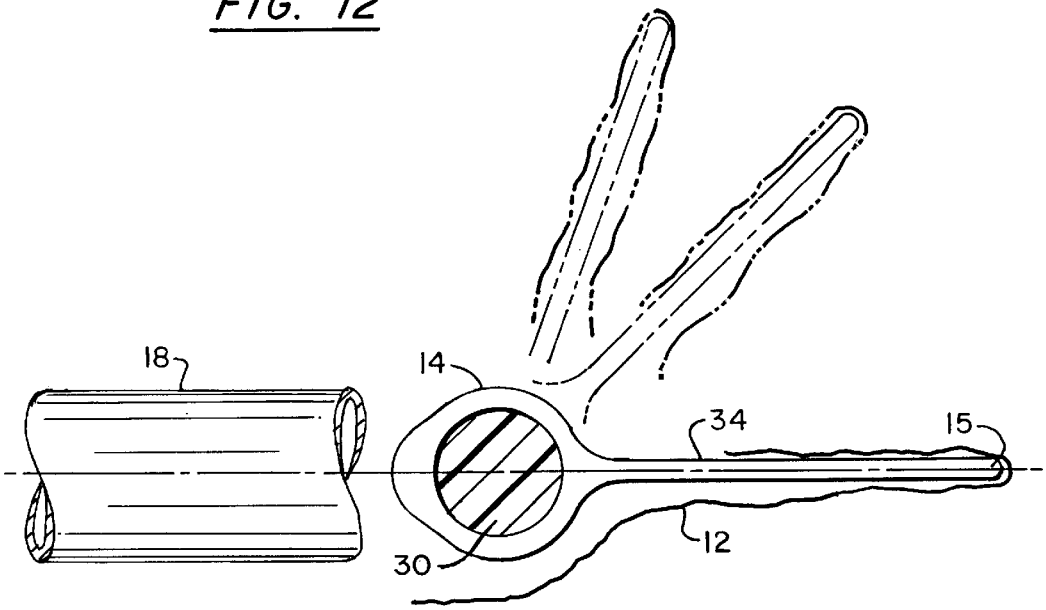
FIG. 13 is a plan section view, showing an edge flap of the edge member of FIG. 1 in three different angular positions.

The edge member 14 is angularly oriented on the support rod 30, preferably so that the flap 34 extends laterally, forwardly and inwardly, at an angle from the vertical plane of the curtain rod 18. Three angular orientations of the edge member 14 are shown in FIG. 13, at which the lateral flap 34 is positioned in the vertical plane of the curtain rod 18 and at 45 degrees and 70 degrees from that plane. In general, the flap 34 is preferably positioned at least 30 degrees and optimally, between 45 to 90 degrees from the vertical plane of the curtain rod 18. The optimum angle depends on the forward limit position of the depending rod 30 imposed by the end piece 50 on the curtain rod and the configuration of the support collar 25, 27 and shower enclosure.

Figure 16:
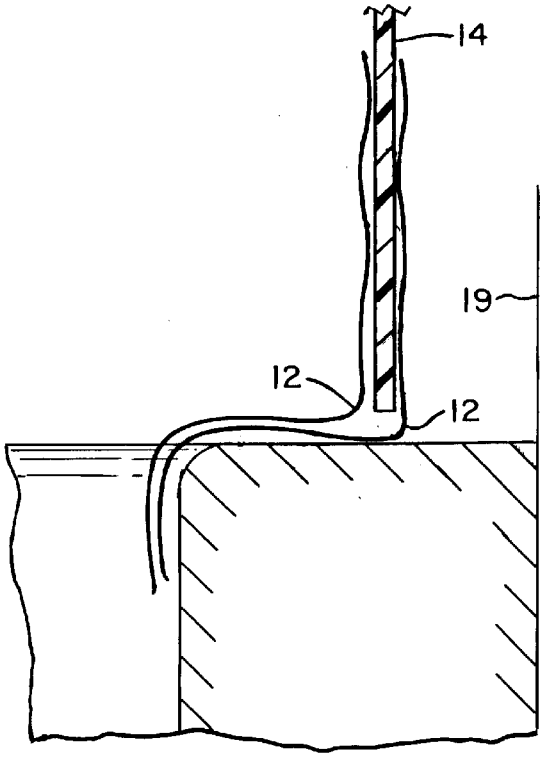

When installed in a bathtub type shower enclosure, the edge member body, including hub 32 and lateral flap 34, preferably is about 120 to 150 cm long and is vertically positioned on the depending rod 30 so that the lower end of the edge member body is slightly (e.g., 5 cm) above the top of the bathtub. The foot 48 is then vertically positioned to lightly engage the bathtub or the shower curtain 12 where it passes under the edge member and over the bathtub (as seen in FIG. 16). The foot 48 thereby helps keep the lower ends of the edge member and shower curtain next to the shower wall 19. A shorter edge member is vertically positioned on the depending rod 30 according to the configuration of the shower enclosure, height of the curtain rod 18, and how the edge member is used. For example, a short edge member, mounted near the top of the shower curtain opening, can be used to support a leading edge section of shower curtain next to the opposed shower wall inwardly of and across the end of the shower curtain opening. When desired, the foot 48 is weighted to help vertically position the edge member.

Figure 14:
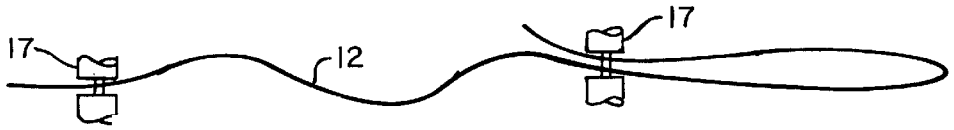
FIG. 14 is an enlarged plan section view, showing a folded leading edge of a shower curtain.
Figure 15:
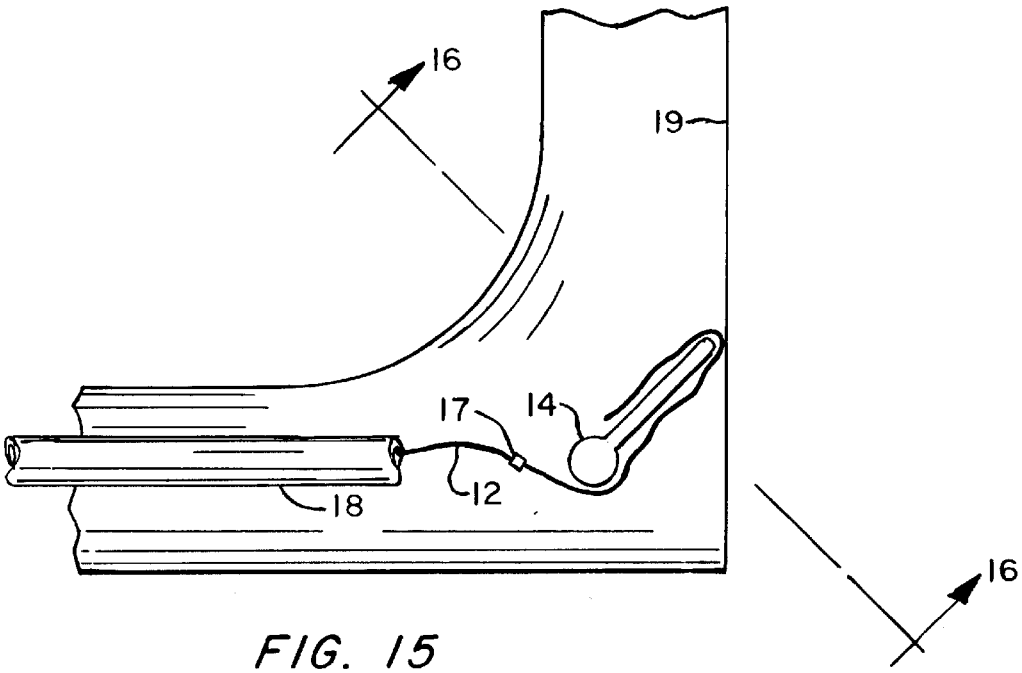
FIGS. 15 and 16 are enlarged plan and elevation section views, respectively, of the installation of FIG. 1, showing the edge member and shower curtain in relation to the bathtub and shower wall when the splash accessory is next to the shower wall.

The first or leading curtain ring 17, for the first and/or second eyes of the curtain 12, is mounted on the curtain rod 18 in front of the hangar assembly 16 or between the front support collar 25, 27 and rear guide 22, depending on the configuration of the hangar assembly 16, angular orientation of the edge member 14 and whether and how the curtain 12 is attached to the edge member 14. A leading edge section of curtain 12 is thereby suspended from the curtain rod 18 in overlapping relationship with the leading edge flap 34 and is shifted on the curtain rod 18 by and with the hangar assembly 16. The first two eyes of the curtain may be mounted on the first ring 17 in front of the support collar 25, 27 to form a wide (e.g., 7 cm wide) leading edge fold as shown in FIG. 14. The edge flap 34 is inserted into the edge fold to loosely attach the curtain to the edge member 14. A suitable (e.g., 7 cm long) U-shaped spring clip (not shown) is preferably mounted on the leading edge fold immediately below the edge flap 34 (and also above the edge flap 34 in addition to or in place of mounting the first curtain eye on the ring 17) to help form the leading edge fold and help retain the edge flap 34 within the fold.

Figure 9:
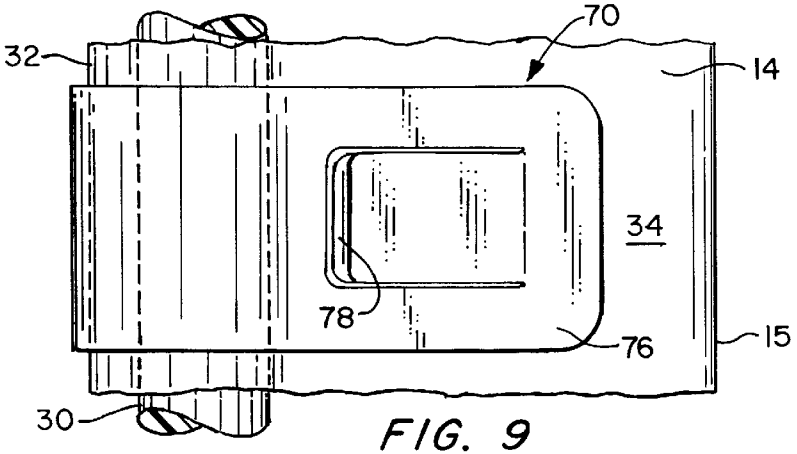
FIGS. 8 and 9 are partial side elevation views of the edge member, showing opposite sides of a spring clamp of the edge member.
Figure 7:
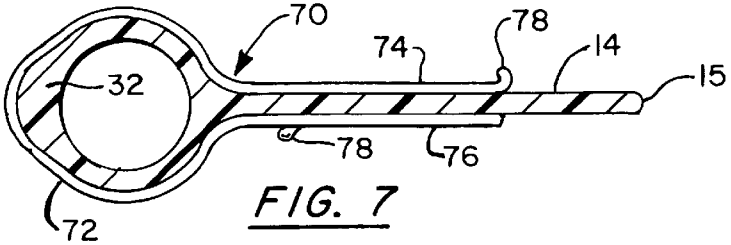
FIG. 7 is an enlarged plan section view, showing an edge member of the splash accessory.
Figure 8:
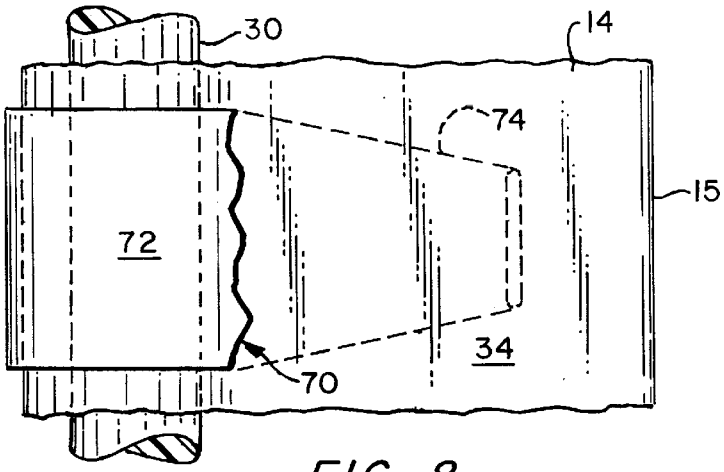

U-shaped spring clamps 70, shown in FIGS. 7–9, are mounted on the edge member body for attaching a leading edge section of curtain to, and supporting it by, the edge flap 34. The clamps 70 are preferably spaced approximately 45–60 cm apart, depending on the length of the flap. The clamps 70 are inserted on one end of the edge member body and vertically positioned as desired. Each clamp 70 has a rear, generally C-shaped, leaf spring portion 72 mounted on and conforming to the hub 32 and two, mostly flat, side clamp portions 74, 76 extending forwardly from opposite ends of the leaf spring 72 and engaging opposite sides of the lateral flap 34. One side clamp 74 is designed to clamp a leading edge section of curtain (folded around the front edge 15) against the opposite face of the flap 34. The other side clamp 76 is designed to clamp a leading edge section of curtain (not folded around the front edge 15) against the adjacent face of the flap 34. Each side clamp 74, 76 has an upturned edge 78 to facilitate raising the side clamp slightly for inserting the curtain under the clamp.

Figure 10:
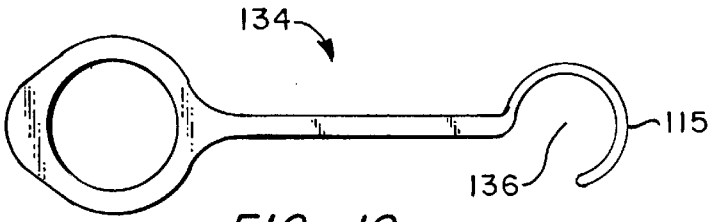
FIG. 10 is a plan view, showing a modified edge member.
Figure 11:
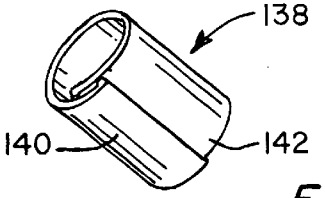
FIG. 11 is an enlarged perspective view of a connector of the modified edge member of FIG. 10.
Figure 12:
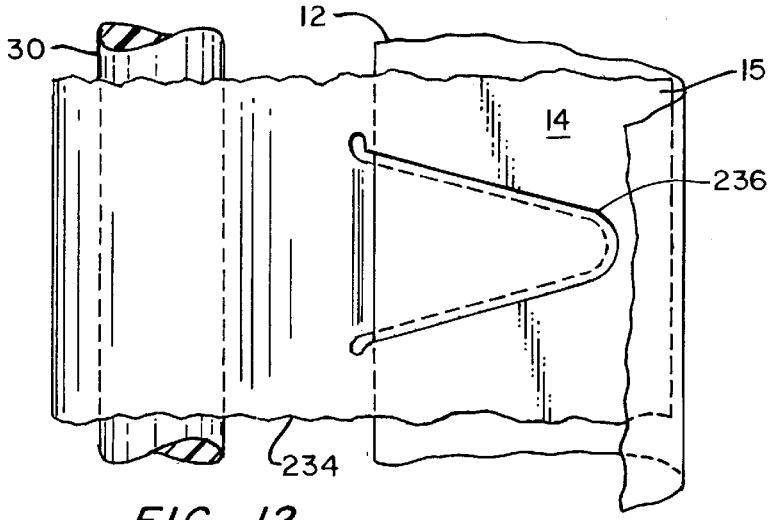
FIG. 12 is a partial side elevation view, showing another modified edge member.

Modified edge flaps 134 and 234, shown in FIGS. 10–12, provide alternative means for attaching a leading edge section of curtain to, and supporting it by, the flap. The wide lateral flap 234, shown in FIG. 12, employs a transversely extending, generally U-shaped, slot 236 for weaving a leading edge section of curtain (folded around the front edge 15) between opposite sides of the flap 234. The slot 236 is preferably spaced inwardly from, but may extend outwardly to, the front edge 15. One or more slots 236 (preferably spaced about 45–60 cm apart) are provided, depending on the flap length.

The wide lateral flap 134, shown in FIG. 10, has an outer convex end forming an elongated internal channel 136, immediately behind the front edge 115 of the flap. The channel 136 has a circular cross-section and a generally rearwardly facing, narrow opening of about 90 degrees on one side of the flap 134. The channel 136 and channel opening are sized to facilitate inserting a leading edge of a shower curtain into the channel. The leading edge is held within the channel 136 by short connectors or slides 138 having outer rings or sleeves 140 dimensioned to be loosely retained (or in the alternative, firmly retained) in the channel 136. Each connector 138 has an internal, integral leaf spring 142 which cooperates with the outer sleeve 140 to provide a narrow opening or throat for inserting a curtain edge into the sleeve 140 and to lightly clamp the inserted curtain part against withdrawal. Each connector 138 is inserted into and removed from the channel 136 through an end of the channel. With some curtains, it is expected that a leading edge part of the curtain can be tucked into and held within the channel 136 without using connectors 138.

When the lateral flap 34, 134, 234 is positioned next to the shower wall and the curtain is attached to and supported by the edge flap as described, a leading edge section of curtain will be suspended along the edge flap and from the edge flap next to the shower wall. Both the flap and shower curtain will extend inwardly of the vertical plane of the curtain rod and therefore can be positioned inwardly of and across the end of the shower curtain opening. If desired, the curtain is suspended from the curtain rod on the side (preferably outside) of the edge member, overlapping the lateral flap but not attached to the flap. The flap is then used only as a splash shield instead of as both a splash shield and a curtain support which positions a leading edge section of curtain. When used only as a splash shield, the edge member preferably extends to or near the bottom of the shower curtain opening.

The described splash accessory can be used with a right-sided shower curtain as shown in the drawings (where the curtain is on the right side of a person standing in the shower enclosure facing the shower) or with a left-sided curtain. The splash accessory can be mounted on the inside of the curtain as shown, or on the outside of the curtain. To modify the splash accessory for use on the opposite side of the curtain or shower enclosure or both, as appropriate, the upright edge member is angularly reoriented and/or reversed end-for-end on the hangar support rod 30, and the clamps 70 and foot 48 are repositioned on the edge member body. A suitable handle (not shown), depending from the free end of the hangar hook 25, 27 on the other side of the curtain from the edge member, can be provided to facilitate positioning the accessory on the curtain rod.

While preferred embodiments of the invention are shown in the drawings and described above, other forms of the invention could be adopted without departing from the scope of the invention, which is set forth in the following claims.

I claim:

1. A splash accessory for a shower curtain suspended from a curtain rod within a shower curtain opening, the curtain being shiftable on the curtain rod to position a leading edge section of curtain next to an opposed shower wall at one end of the shower curtain opening; the splash accessory comprising an elongated edge member, and hangar means for hanging the splash accessory from the curtain rod with the edge member suspended in a generally upright position from the curtain rod at a forward position next to the shower wall; the improvement wherein the hangar means comprises an elongated hangar rod with an upper hook for hanging the splash accessory from the curtain rod and a lower depending support rod, wherein the edge member has a hub mounted on the depending rod and has a forward, longitudinally extending, generally imperforate, splash shield flap extending laterally outwardly from the hub and extending laterally, forwardly and inwardly, at an angle of between 30 to 90 degrees from the vertical plane of the curtain rod, and therefore inwardly of and across the end of the curtain opening when the edge member is next to the opposed shower wall.

2. A splash accessory according to claim 1, wherein the hangar means and edge member have cooperating means for angularly positioning the edge member about a longitudinally extending axis rearward of the splash shield flap for angularly positioning the splash shield flap relative to said plane.

3. A splash accessory according to claim 1, wherein the edge member has means for attaching a leading edge section of curtain to the splash shield flap.

4. A splash accessory according to claim 3, wherein the attachment means comprises transversely extending slots in the splash shield flap for weaving a leading edge section of curtain between opposite sides of the splash shield flap.

5. A splash accessory according to claim 1, wherein the edge member comprises a foot vertically adjustable in the lower end of the hub.

6. A splash accessory according to claim 1, wherein the upper hook has a pivot edge engageable with the curtain rod for hanging the splash accessory from the curtain rod, the pivot edge being offset from the axis of the depending support rod.

7. A splash accessory according to claim 1, wherein the edge member comprises at least one transverse spring clamp having a leaf spring partly surrounding the hub and at least one side clamp at one end of the leaf spring in engagement with one side of the splash shield for clamping a leading edge section of curtain therebetween.

8. A splash accessory according to claim 5, wherein the edge member comprises at least one transverse spring clamp having a leaf spring partly surrounding the hub and at least one side clamp at one end of the leaf spring in engagement with one side of the splash shield for clamping a leading edge section of curtain therebetween.

9. A splash accessory according to claim 8, wherein the spring clamp has a pair of side clamps at opposite ends of the leaf spring in engagement with opposite sides of the splash shield for clamping a leading edge section of curtain therebetween.

10. A splash accessory according to claim 1, wherein the hangar means further comprises a rear guide having a guide collar for receiving a curtain rod rearwardly of the support hook and a hub mounted on the depending rod.

11. A splash accessory according to claim 1, wherein the splash shield flap is generally flat and extends radially outwardly from the hub.

12. A shower curtain splash accessory comprising an edge member with an elongated, wide, generally imperforate flap with a longitudinally extending leading edge, hangar means for hanging the splash accessory from a shower curtain rod with the edge member suspended from the curtain rod and the flap in a generally upright position and extending laterally, forwardly and inwardly, at an angle of between 30 to 90 degrees from the vertical plane of the curtain rod, the hangar means comprising an elongated hangar rod with an upper collar for hanging the splash accessory from the curtain rod and a lower depending support rod, the edge member having a hub mounted on the depending rod with the flap extending laterally outwardly from the hub, the edge member having attachment means for attaching a leading edge section of curtain to the flap to form therewith a combined splash barrier, the hangar means being shiftable on the curtain rod to shift said combined splash barrier between a withdrawn position withdrawn from an opposed shower wall at one end of a curtain opening and a forward position next to the opposed shower wall with the flap and attached leading edge section of curtain extending laterally inwardly from the curtain opening.

13. A splash accessory according to claim 12, wherein the hangar means and edge member have cooperating means for angularly positioning the edge member about a longitudinally extending axis rearward of the flap for angularly positioning the flap relative to said plane.

14. A splash accessory according to claim 12, wherein the attachment means comprises transversely extending slots in the flap for weaving a leading edge section of curtain between opposite sides of the flap.

15. A splash accessory for a shower curtain suspended from a curtain rod within a shower curtain opening, the splash accessory having a curtain support with attachment means for suspending a leading edge section of curtain therefrom and hangar means for hanging the splash accessory from a curtain rod with the curtain support suspended from the curtain rod, the hangar means being shiftable on the curtain rod to shift the suspended curtain support, and a leading edge section of curtain suspended therefrom, between a withdrawn position withdrawn from an opposed shower wall at one end of the curtain opening and a forward position with the curtain support, and a leading edge section of curtain suspended therefrom, next to the opposed shower wall; the improvement wherein the curtain support and hangar means have cooperating means for angularly positioning the curtain support about an axis generally perpendicular to the curtain rod, for angularly positioning the curtain support, and a leading edge section of curtain suspended therefrom, inwardly of the vertical plane of the curtain rod, wherein the curtain support comprises a wide, upright flap with an elongated leading edge parallel to said axis. and wherein the attachment means is operable to attach a leading edge section of curtain folded around the leading edge to the opposite side of the flap.

16. A splash accessory according to claim 15, wherein said cooperating means comprises a depending rod, forming part of the hangar means, and a hub, forming part of the curtain support, mounted on the depending rod.

17. A splash accessory according to claim 16 wherein the hub can be angularly and vertically positioned on the depending rod for angularly and vertically positioning the curtain support.

* * * * *